US005833141A

United States Patent [19]

Bechtel, II et al.

[11] Patent Number: 5,833,141

[45] Date of Patent: Nov. 10, 1998

[54] ANTI-COKING DUAL-FUEL NOZZLE FOR A GAS TURBINE COMBUSTOR

[75] Inventors: William Theodore Bechtel, II, Scotia; Stephen Hugh Black, Duanesburg; Anthony John Dean, Scotia, all of N.Y.; Andrew Luts, Escondido, Calif.

[73] Assignee: General Electric Company, Schenectady, N.Y.

[21] Appl. No.: 866,366

[22] Filed: May 30, 1997

[51] Int. Cl.[6] ..... B05B 7/06; B05B 7/10; F02C 1/00

[52] U.S. Cl. ..... 239/406; 239/419.3; 239/422; 239/424; 239/428; 239/463; 60/39.463; 60/748

[58] Field of Search ..... 239/400, 403, 239/405, 406, 418, 419, 419.3, 422, 423, 424, 424.5, 425, 428, 429, 463, 489; 60/39.463, 748

[56] References Cited

U.S. PATENT DOCUMENTS

| | | | |
|---|---|---|---|
| 908,249 | 12/1908 | Gruda | 239/428 X |
| 1,641,204 | 9/1927 | Egan | 239/400 X |
| 3,627,204 | 12/1971 | Stand | 239/406 X |
| 4,447,010 | 5/1984 | Maeda et al. | 239/428 X |
| 4,962,889 | 10/1990 | Halvorsen | 239/406 X |
| 5,404,711 | 4/1995 | Rajput | 60/39.463 |
| 5,505,045 | 4/1996 | Lee et al. | 239/424 X |
| 5,647,538 | 7/1997 | Richardson | 239/423 X |
| 5,697,553 | 12/1997 | Stotts | 239/424 X |

*Primary Examiner*—Andres Kashnikow
*Assistant Examiner*—Robin O. Evans
*Attorney, Agent, or Firm*—Nixon & Vanderhye

[57] ABSTRACT

The dual-fuel nozzle includes a liquid fuel nozzle surrounded by an air/gas premixing cup. The cup has a base comprised of swirler vanes surrounding the outer tube of the liquid fuel nozzle. The tip of the liquid fuel nozzle extends to adjacent the open end of the premixing cup opposite the swirler vanes. The interior surface and outer surface of the premix cup and the tip of the liquid fuel nozzle, respectively, at the outer end of the cup are contoured, i.e., tapered complementarily inwardly to avoid recirculation of air in the annulus between the liquid fuel nozzle and the cup. Air recirculation is also prevented, thereby inhibiting flame holding adjacent the base of the cup by providing a smooth transition for air flow through the openings of the swirler at the base of the cup and into the annulus.

9 Claims, 3 Drawing Sheets

ANTI-COKING DUAL-FUEL NOZZLE FOR A GAS TURBINE COMBUSTOR

TECHNICAL FIELD

The present invention relates to a dual-fuel nozzle for a gas turbine combustor and particularly to a dual-fuel nozzle for a turbine combustor wherein the formation of carbon on the fuel nozzle surfaces is minimized or eliminated.

BACKGROUND

In dual-fuel combustion systems for gas turbines, gaseous and liquid fuel are used separately to fire the gas turbine. Because of the cost differential between natural gas and fuel oil, operation of gas turbines using oil has been considered as a temporary or backup to be used only when natural gas is not available. Additionally, it is less difficult to premix a gaseous fuel with air to achieve dry low $NO_x$ emissions than to use oil. For these reasons, the development of dry low $NO_x$ systems has been directed primarily toward use of gaseous fuels and dual-fuel nozzle system designs focussed primarily on gas fuel operation. The developmental emphasis in dual-fuel nozzles for operating principally with gaseous fuels has led to designs wherein the oil fuel nozzle part of the dual-fuel nozzle is compromised. Further, it has been demonstrated that carbon will build up on the gas turbine over time when using oil such that the efficiency of the gas turbine is compromised. In some cases, the gas turbine has been rendered inoperable or damaged.

While the problem of carbon buildup has been recognized, the solution oftentimes was to limit the gas turbine operator's operating envelope and duration of fired hours with liquid fuel between operations with gas. Operations with gas fuel typically burns away most of the carbon buildup if it is not too extensive, although this is problematical.

In prior dual-fuel nozzles, the oil fuel nozzle is essentially a series of concentrical axially extending sleeves for flowing atomizing air, water and fuel oil generally along the axis of the combustor. The liquid nozzle tip is situated at the base of the flame cup which extends forwardly along the axis of the nozzle. The base of the cup has swirler vanes defining openings therebetween for admitting air into the cup. Gas fuel nozzles are located about the liquid fuel nozzle to admit gas fuel into the region of the air swirler openings such that the gas/air mixture would typically flow in an annular pattern within the cup with a low velocity region along the axis of the cup. It has been found, however, contrary to assumptions made in the original design of dual-fuel nozzles, that the forward momentum of the oil spray combined with the momentum of the air passing through the cup from the air swirler at the base of the cup does not sweep the oil droplets out of the cup. It has been demonstrated that air recirculation patterns within the cup capture and transport a fraction of the oil to the base of the cup. This oil impinges on the air swirler vanes, the face of the oil nozzle, the side of the cup and forms carbon/coke on these surfaces.

DISCLOSURE OF THE INVENTION

In accordance with the present invention, there is provided a dual-fuel nozzle for a gas turbine which essentially eliminates the formation of carbon within the nozzle, ensures that the flame does not stabilize inside the air/gas passageway of the dual-fuel nozzle, maintains the successful characteristics of the gas fuel nozzle while simultaneously not restricting use of the nozzle in a fuel oil mode and ensures efficient dependable operation of the dual-fuel nozzle over a substantial period of time. To accomplish this, the oil fuel nozzle in accordance with the present invention is extended axially from the base of the cup, particularly the air swirler, such that the oil fuel outlet tip lies substantially coterminous with the exit end of the cup. To entirely eliminate recirculation of oil upstream in the cup and to eliminate flame holding at the base of the cup behind the slotted vanes of the air swirler, the dual-fuel nozzle of this invention provides a number of features. First, with the exit tip of the liquid fuel nozzle terminating adjacent the exit end of the cup, the inner wall surface of the cup and the outer wall surface of the nozzle tip are tapered toward the axis in a downstream direction. This eliminates entrainment of oil droplets in the recirculating air near the cup exit and which otherwise would impinge upon and coat the outer oil tip with carbon. Secondly, in prior designs, the openings defined by the swirlers included a step at the base of the cup which afforded a region of air recirculation and potential flame holding. In the present design, the step is eliminated and the openings are located directly adjacent the interior wall of the cup at its base. Thirdly, the sizing of the air/gas passageway is such that the air velocity sweeps any flame out of the passage that may initiate in those passages. Finally, an additional swirler is formed about the external surface of the cup to promote the air fuel mixing process for both fuel types. It will be appreciated that the extension of the oil nozzle and the complementary contours of the cup and outer oil tip do not compromise the characteristics of the gaseous nozzle. That is, the air/gas fuel flow is fundamentally unchanged and continues to flow in the outer annular area within the cup.

In a preferred embodiment according to the present invention, there is provided a dual-fuel nozzle for a gas turbine combustor, comprising a generally cylindrical cup having an axis, an exit end and a base opposite the exit end, the base including swirl vanes having openings therebetween for swirling air introduced into the cup through the base openings, a gas fuel nozzle inlet adjacent the base of the cup for mixing gas fuel with air introduced into the cup through the base openings and a liquid fuel nozzle extending through the cup base generally along the axis of the cup defining an annular region between the liquid fuel nozzle and the cup for receiving the gas/air mixture, the liquid fuel nozzle terminating in a liquid fuel tip adjacent the exit end of the cup, thereby substantially avoiding impingement of liquid fuel onto the nozzles.

Accordingly, it is a primary object of the present invention to provide a novel and improved dual-fuel nozzle for a gas turbine combustor which minimizes or eliminates the formation of carbon on the fuel nozzle surfaces and enables efficient, dependable combustion performance on both gas and oil fuel over the entire gas turbine operating range.

BEST MODE FOR CARRYING OUT THE INVENTION

Figure 1:
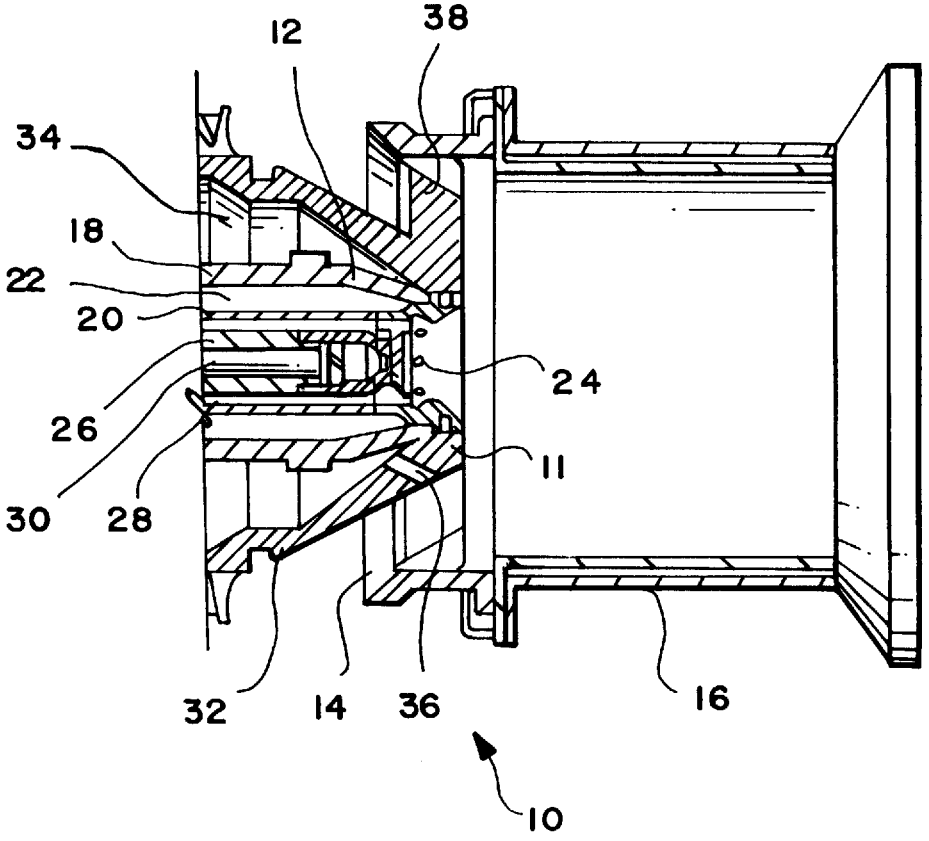
Fig. 1 (Prior Art)
FIG. 1 is a partial side elevational view with parts in cross-section of the tip and cup of a dual-fuel nozzle according to the prior art.

A prior art dual-fuel nozzle, generally designated 10, is illustrated in FIG. 1. In nozzle 10, the tip 11 of a liquid fuel nozzle 12 is illustrated within the base 14 of a gas premix cup 16 which extends axially beyond the tip of the liquid nozzle 12. The liquid, e.g., oil, fuel nozzle includes a pair of outer and intermediate concentric tubes 18 and 20, respectively, defining an annular passage for flowing atomizing air through apertures 24 in the tip 11 of the liquid fuel nozzle 12. An inner tube 26 is spaced inwardly from intermediate tube 20 and defines an annular passageway 28 for flowing water to the tip of the liquid fuel nozzle. The central passageway in the inner tube 26 provides liquid fuel such as oil to the liquid fuel nozzle tip 11.

Figure 2:
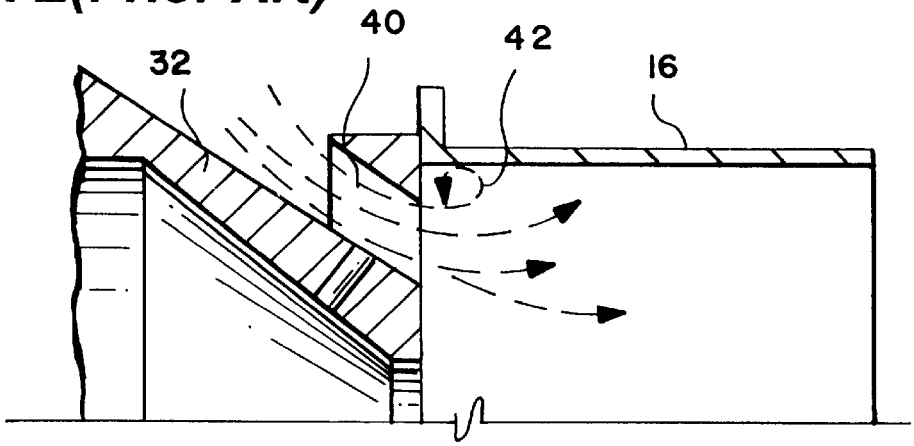
Fig. 2(Prior Art)
FIG. 2 is an enlarged fragmentary cross-sectional view illustrating the air swirler openings for the dual-fuel nozzle of the prior art.

Surrounding the tip of the liquid fuel nozzle is a housing 32 which defines an annular passageway 34 for flowing gas fuel through apertures 36 into the gas premixing cup 16. The base of the premixing cup has a plurality of vanes 38 with openings 40 therebetween (FIG. 2) for receiving air, for example, from a compressor.

As indicated previously, in the design of the prior art dual-fuel nozzle 10, an assumption was made that the forward momentum of the oil spray, combined with the momentum of the air passing through the cup from the air swirler at the base of the cup, would be sufficient to sweep oil droplets out of the cup and hence prevent carbon build-up on the interior of the cup and the liquid fuel nozzle tip. However, it has been demonstrated that the air flow patterns within the cup and particularly adjacent the base of the cup capture and transport a fraction of the oil forward to the base of the cup. This oil impinges on the air swirler vanes and the face of the oil nozzle, as well on the side of the cup and forms carbon/coke deposits on those surfaces. A recirculation pattern is illustrated at 42 in FIG. 2 caused by a step between the large diameter premix cup and the outer end of the swirler vane openings. Consequently, there was a need to eliminate the deposition of carbon on the dual-fuel nozzle, to ensure that the flame would not stabilize inside the air/gas passageway of the dual-fuel nozzle, to promote further fuel/air mixing and to ensure efficient dependable operation of the dual-fuel nozzle over a long period of time.

Figure 3:
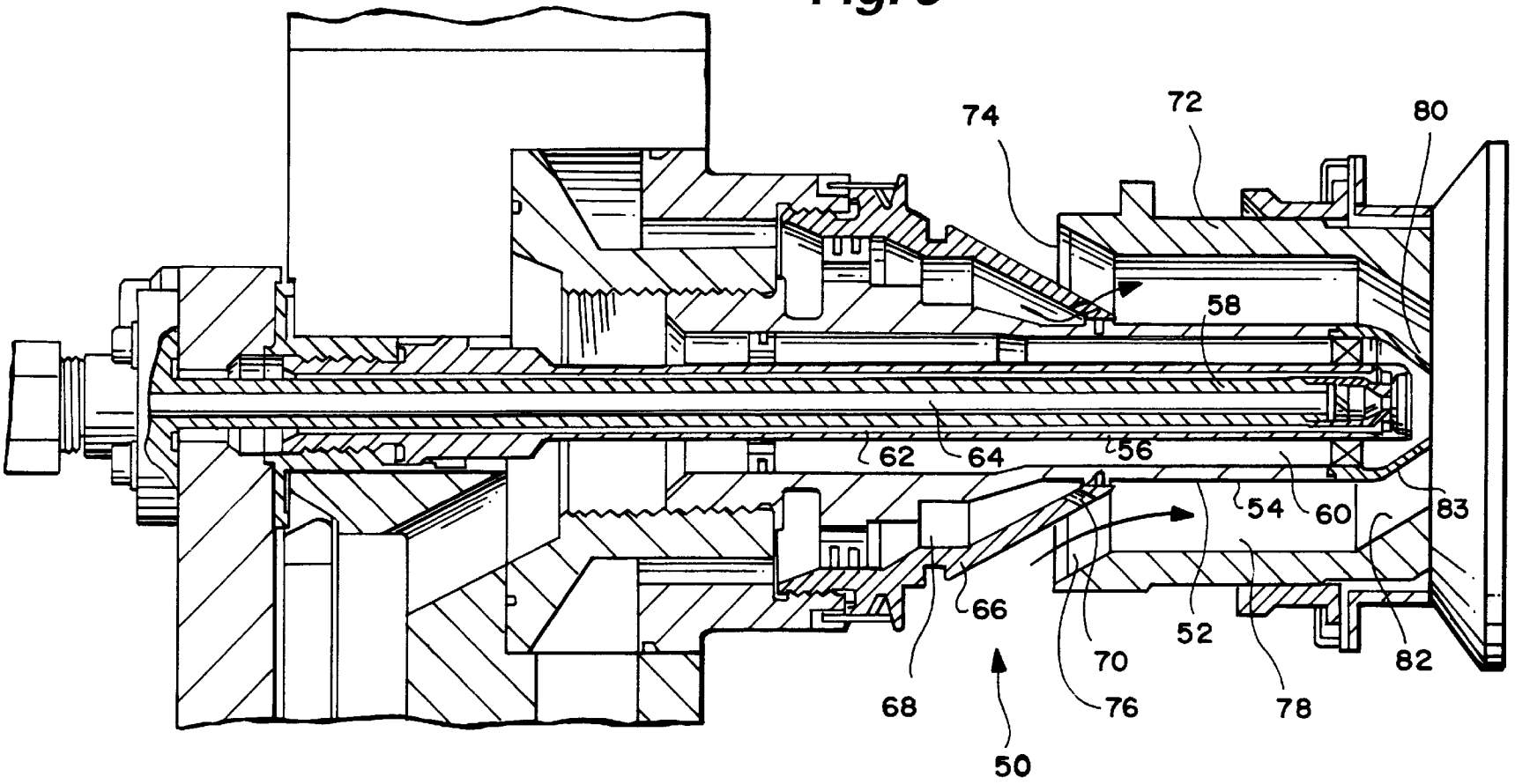
FIG. 3 is a longitudinal cross-sectional view of a dual-fuel nozzle according to the present invention.
Figure 5:
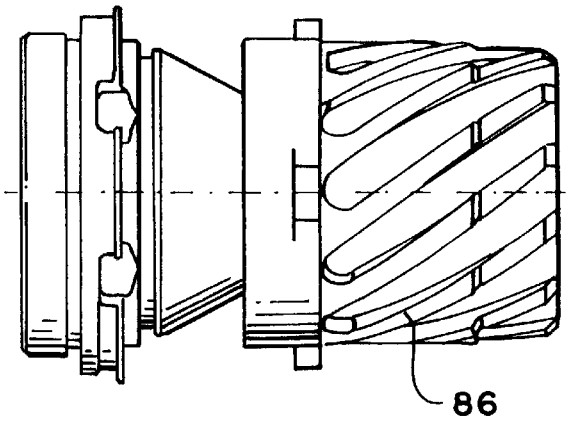
FIG. 5 is a side elevational view on a reduced scale of the dual-fuel nozzle according to the present invention.
Figure 4:
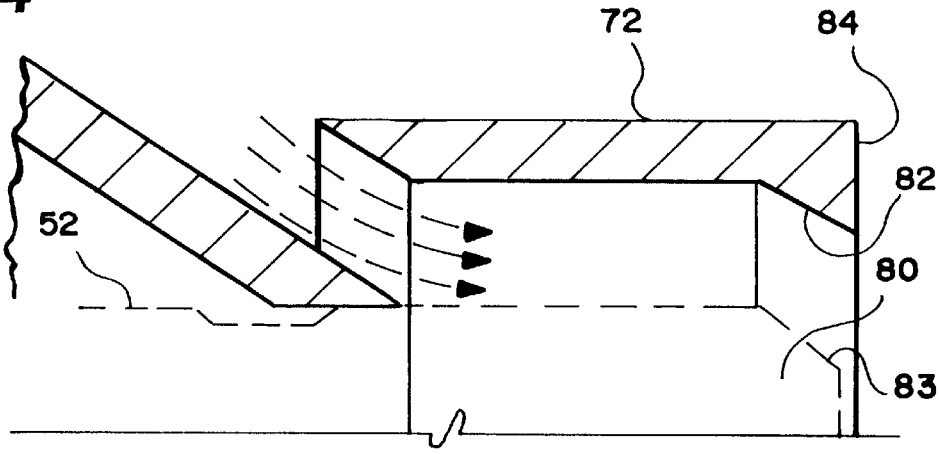
FIG. 4 is an enlarged cross-sectional view of the air swirler inlet region and the complementary-shaped exit ends of the cup and liquid nozzle for the dual-fuel nozzle of the present invention.

To accomplish this, the present invention provides a dual-fuel nozzle as illustrated in FIGS. 3, 4 and 5. The dual-fuel nozzle 50 of the present invention includes a liquid fuel nozzle 52 comprising outer, intermediate and inner tubes 54, 56 and 58, respectively. The annular passageway 60 between the outer and intermediate tubes 54 and 56 defines a passageway for delivering atomized air to the tip 80 of the liquid fuel nozzle 52. The annular passageway 62 between the intermediate tube 56 and inner tube 58 defines a water passageway for flowing water to the tip 80 of the liquid fuel nozzle 52. The inner passageway within the inner tube 58 is for supplying fuel oil to the tip of the liquid nozzle. A housing 66 surrounds the outer tube 54 and includes a passageway 68 for flowing gaseous fuel to circumferentially spaced apertures 70 situated at the base of premixing cup 72.

As illustrated, the premixing cup 72 is generally cylindrical in configuration and includes at its base a plurality of circumferentially spaced swirler vanes 74 defining openings 76 therebetween for receiving compressed air from a suitable source, such as a compressor. The air through the openings in the swirler vanes 74 flows into the annular space 78 between the outer tube 54 and the cylindrical wall of the premixing cup 72.

It is a feature of the present invention that the tip 80 of the liquid fuel nozzle terminates adjacent the open end of the premixing cup 72 as illustrated in FIGS. 3 and 4. Upon comparing the dual-fuel nozzle of the prior art of FIG. 1 with the invention of FIG. 3, it will be readily appreciated that the liquid fuel exits the tip 80 of the liquid fuel nozzle 52 at a distance well downstream from the cup base and approximating the length of the premixing cup. Hence, significant impingement of oil on the interior surfaces of the cup as well as the exterior surfaces of the liquid fuel nozzle itself is avoided. However, it has been found that the extension of the tip of the liquid fuel nozzle to the exit opening of the premixing cup does not entirely eliminate recirculation of oil upstream in the cup and, hence, did not eliminate coating the outer surface of the oil tip with carbon. Secondly, it also created the problem of stable flame holding at the base of the cup behind the slotted vanes of the air swirler. This flame holding, if allowed to persist, damages the cup and outer liquid fuel tip 80 by heating the metal to its melting point.

To cure those problems while extending the tip 80 of the liquid fuel nozzle 52 to adjacent the open end of the premixing cup, the sizing of the air/gas passageways are such that the air velocity sweeps any flame out of the passage that may initiate therein. Secondly, the region of air recirculation, i.e., region 42 in the prior art drawing of FIG. 2, has been eliminated in the present dual-fuel nozzle. That is, the step at the exit end of the openings 40 of the air swirlers in the prior cup adjacent the outer wall of the cup have been eliminated and the compressed air flow is permitted to flow smoothly into the annular region 78 of the premix cup. Thus, the potential location for holding the flame at the base of the cup has been eliminated.

Additionally, the end of the cup 72 and the outer oil tip 80 are contoured such that air and oil droplet recirculation is eliminated in the annular passage 78. As best illustrated in FIG. 4, the interior end surface 82 of the exit end of the cup 72 is tapered inwardly generally complementary to the taper of the outer surface 83 of the outer tube 54 of the liquid fuel nozzle tip 80. This eliminates air recirculation in air passage 78 and precludes oil droplets from being entrained in air recirculating near the cup exit which otherwise would have impinged on and coated the outer fuel oil tip with carbon. Additionally, carbon deposits do not form on the downstream face 84 (FIG. 4) of the premixer cup because of a combination of high surface temperature (due to proximity to the flame) and a low level of impingement of oil droplets onto the surface.

Additionally, as illustrated in FIG. 5, the outer wall of the cup has an additional swirler 86 formed in its surface to enable additional air to flow into the premixing zone of the combustor. This further promotes the air/fuel mixing process for both types of fuel.

It will be appreciated that the extension of the oil nozzle and the contouring of the cup and outer oil tip have not compromised the characteristics of the gas fuel nozzle. This is because the air/gas fuel flow pattern is fundamentally unchanged. In the standard nozzle design illustrated in FIGS. 1 and 2, the air/gas mixture flows along the outer edge of the cup due to the centrifugal forces imparted to the flow by the air swirler vanes. The central axial region of the cup is a low velocity recirculation region. In both the present invention and the prior dual-fuel nozzle designs, the air/gas flow from the base to the exit of the cup is annular in configuration. Additionally, it will be appreciated that in the present invention, the cup is attached to the outer diameter of the air swirler and forms the outer wall of the passageway for the air and fuel gas when the turbine is fired with gaseous fuel. The inner wall of the cup is reduced in diameter to eliminate the backward-facing step illustrated in the prior art of FIG. 2 at the outer diameter of the swirl vane. This diameter reduction also narrows the air/gas passageway, thereby increasing the air velocity in the passageway. Both the elimination of the backward facing step and the increase in the air velocity inhibit flame holding within the air/gas passageway. By forming a slotted swirler along the outer wall of the cup as illustrated in FIG. 5, this additional air further promotes the mixing of the fuel and air in the combustion region. Also, the outer oil tip forms the inner wall of the air/gas passageway and is contoured to match the cup inner wall profile such that the air does not recirculate within the passage. The outer oil tip, oil injector and the associated atomizing air and water passages which comprise the entire outer oil tip assembly are thus all extended substantially to the end of the premixing cup so that the fuel oil does not impinge directly on the cup walls.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dual-fuel nozzle for a gas turbine combustor, comprising:

a generally cylindrical cup having an axis, an exit end and a base opposite said exit end, said base including swirl vanes having openings therebetween for swirling air introduced into the cup through said base openings;

a gas fuel nozzle inlet adjacent the base of the cup for mixing gas fuel with air introduced into the cup through said base openings; and a liquid fuel nozzle extending through said cup base generally along the axis of the cup defining an annular region between said liquid fuel nozzle and said cup for receiving the gas/air mixture, said liquid fuel nozzle terminating in a liquid fuel tip adjacent said exit end of said cup, thereby substantially avoiding impingement of liquid fuel onto said nozzles.

2. A nozzle according to claim 1 wherein the liquid fuel nozzle tip and an interior wall portion of said cup adjacent said exit end thereof are generally complementarily contoured relative to one another to substantially eliminate recirculation of air and oil droplets within the annulus.

3. A nozzle according to claim 1 wherein the liquid fuel nozzle tip and an interior wall portion of said cup adjacent said exit end thereof have respective surfaces tapered inwardly toward the axis of the cup and exit end thereof.

4. A nozzle according to claim 3 wherein said surfaces are generally complementary in shape relative to one another.

5. A nozzle according to claim 1 wherein said openings are in part defined by interior side wall portions of said cup, thereby to substantially eliminate reverse flow of air adjacent the base of the cup.

6. A nozzle according to claim 5 wherein the liquid fuel nozzle tip and an interior wall portion of said cup adjacent said exit end thereof are generally complementarily contoured relative to one another to substantially eliminate recirculation of air and oil droplets within the annulus.

7. A nozzle according to claim 5 wherein the liquid fuel nozzle tip and an interior wall portion of said cup adjacent said exit end thereof have respective surfaces tapered inwardly toward the axis of the cup and exit end thereof.

8. A nozzle according to claim 7 wherein said surfaces are generally complementary in shape relative to one another.

9. A nozzle according to claim 1 wherein said cup has an outer surface with spirally formed grooves for swirling air flowing about the exterior of said cup.

* * * * *